US012559829B2

(12) United States Patent
Kim et al.

(10) Patent No.: US 12,559,829 B2
(45) Date of Patent: Feb. 24, 2026

(54) HOT-DIP Zn—Al—Mg-BASED ALLOY-PLATED STEEL MATERIAL HAVING EXCELLENT CORROSION RESISTANCE OF PROCESSED PORTION, AND METHOD FOR MANUFACTURING SAME

(71) Applicant: POSCO, Pohang-si (KR)

(72) Inventors: Heung-Yun Kim, Pohang-si (KR); Sung-Joo Kim, Gwangyang-si (KR); Yong-Joo Kim, Gwangyang-si (KR); Dae-Young Kang, Gwangyang-si (KR)

(73) Assignee: POSCO, Pohang-si (KR)

( * ) Notice: Subject to any disclaimer, the term of this patent is extended or adjusted under 35 U.S.C. 154(b) by 223 days.

(21) Appl. No.: 17/787,019

(22) PCT Filed: Dec. 2, 2020

(86) PCT No.: PCT/KR2020/017416
§ 371 (c)(1),
(2) Date: Jun. 17, 2022

(87) PCT Pub. No.: WO2021/125630
PCT Pub. Date: Jun. 24, 2021

(65) Prior Publication Data

US 2023/0021399 A1 Jan. 26, 2023

(30) Foreign Application Priority Data

Dec. 18, 2019 (KR) ..... 10-2019-0169494

(51) Int. Cl.
*C23C 2/06* (2006.01)
*C23C 2/26* (2006.01)
*C23C 2/28* (2006.01)

(52) U.S. Cl.
CPC ..... *C23C 2/06* (2013.01); *C23C 2/26* (2013.01); *C23C 2/29* (2022.08)

(58) Field of Classification Search
CPC .... C23C 2/06; C23C 2/26; C23C 2/29; C23C 2/02; C23C 18/04; C23C 2/022;
(Continued)

(56) References Cited

U.S. PATENT DOCUMENTS

2014/0037856 A1 2/2014 Moon et al.
2018/0245175 A1 8/2018 Li et al.
(Continued)

FOREIGN PATENT DOCUMENTS

CN 108588491 A 9/2018
CN 110100036 A 8/2019
(Continued)

OTHER PUBLICATIONS

JP-2004068075-A English translation (Year: 2004).*
(Continued)

*Primary Examiner* — Hai Y Zhang
(74) *Attorney, Agent, or Firm* — Morgan Lewis & Bockius LLP

(57) ABSTRACT

An exemplary embodiment in the present disclosure provides a hot-dip Zn—Al—Mg-based alloy-plated steel material having excellent corrosion resistance in a processed portion, and a method for manufacturing the same. The steel material includes: an iron substrate; and a hot-dip alloy-plated layer formed on the iron substrate, wherein the hot-dip alloy-plated layer contains, by wt %, more than 8% to 25% of Al, more than 4% to 12% of Mg, and a balance of Zn and inevitable impurities, a fraction of a MgZn2 phase in the hot-dip alloy-plated layer is 10 to 45 area %, cracks are formed inside the MgZn2 phase, and the number of cracks present per 100 μm in a direction perpendicular to a thickness direction of a steel sheet in a field of view in which the cracks are observed based on a cross section in the thickness direction of the steel sheet is 3 to 80.

2 Claims, 3 Drawing Sheets

(58) Field of Classification Search
CPC .... C23C 2/16; C23C 2/18; C23C 2/20; C23C 2/40; C23C 2/261; C23C 30/00
See application file for complete search history.

(56) References Cited

U.S. PATENT DOCUMENTS

| | | | |
|---|---|---|---|
| 2019/0010595 | A1 | 1/2019 | Oh et al. |
| 2019/0345584 | A1 | 11/2019 | Hong et al. |
| 2020/0017946 | A1 | 1/2020 | Lee et al. |
| 2021/0010106 | A1 | 1/2021 | Kim et al. |
| 2021/0147971 | A1 | 5/2021 | Harada et al. |

FOREIGN PATENT DOCUMENTS

| | | | | |
|---|---|---|---|---|
| EP | 3409807 | A1 | | 12/2018 |
| JP | H02-170961 | A | | 7/1990 |
| JP | H11-158656 | A | | 6/1999 |
| JP | H11-323524 | A | | 11/1999 |
| JP | 2001-295018 | A | | 10/2001 |
| JP | 2003-147500 | A | | 5/2003 |
| JP | 200468075 | | † | 3/2004 |
| JP | 2004068075 | A | * | 3/2004 |
| JP | 2005-272922 | A | | 10/2005 |
| JP | 2005-336546 | A | | 12/2005 |
| JP | 2017-66457 | A | | 4/2017 |
| KR | 10-2002-0004231 | A | | 1/2002 |
| KR | 10-2014-0018098 | A | | 2/2014 |
| KR | 10-2014-0074231 | A | | 6/2014 |
| KR | 20140074231 | A | * | 6/2014 ..... C23C 2/50 |
| KR | 10-2015-0074977 | A | | 7/2015 |
| KR | 10-2017-0076924 | A | | 7/2017 |
| KR | 10-2019-0078509 | A | | 7/2019 |
| WO | 2019/132337 | A1 | | 7/2019 |
| WO | 2019/132412 | A1 | | 7/2019 |

OTHER PUBLICATIONS

KR-20140074231-A_English translation. (Year: 2014).*
Chinese Office Actionn dated Apr. 14, 2023 issued in Chinese Patent Application No. 202080088446.8.
Li Shi-wei et al., "Effects of Mg on the Microstructure, Corrosion Resistance and Formability of Galvalume Coatings," Journal of Northeastern University (Natural Science), vol. 34, No. 8, Aug. 2013.
Japanese Office Action dated Dec. 5, 2023 issued in Japanese Patent Application No. 2022-536987.
Office Action issued Jun. 27, 2023 for corresponding Japanese Patent Application No. 2022-536987.
International Search Report dated Apr. 26, 2021 issued in International Patent Application No. PCT/KR2020/017416 (with English translation).
Extended European Search Report dated Sep. 9, 2022 issued in European Patent Application No. 20901352.3.

* cited by examiner
† cited by third party

【Fig. 1】
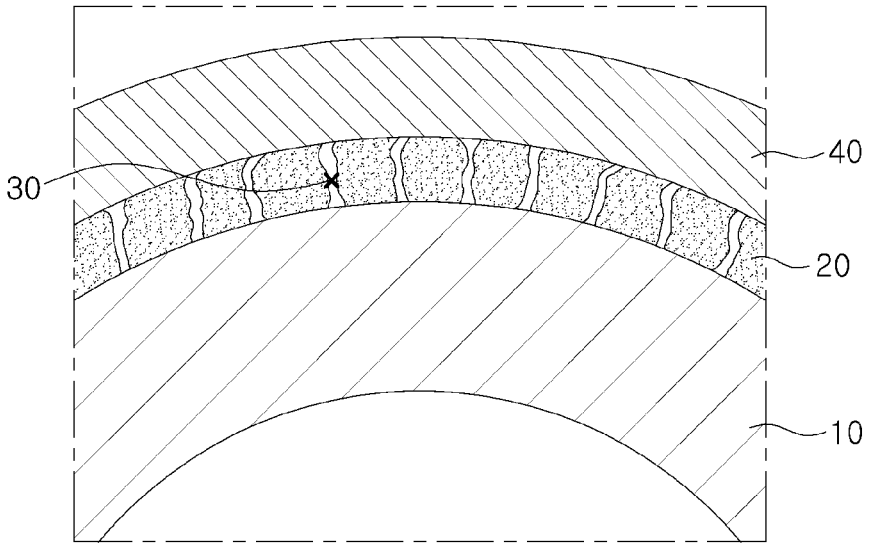
【Fig. 2】
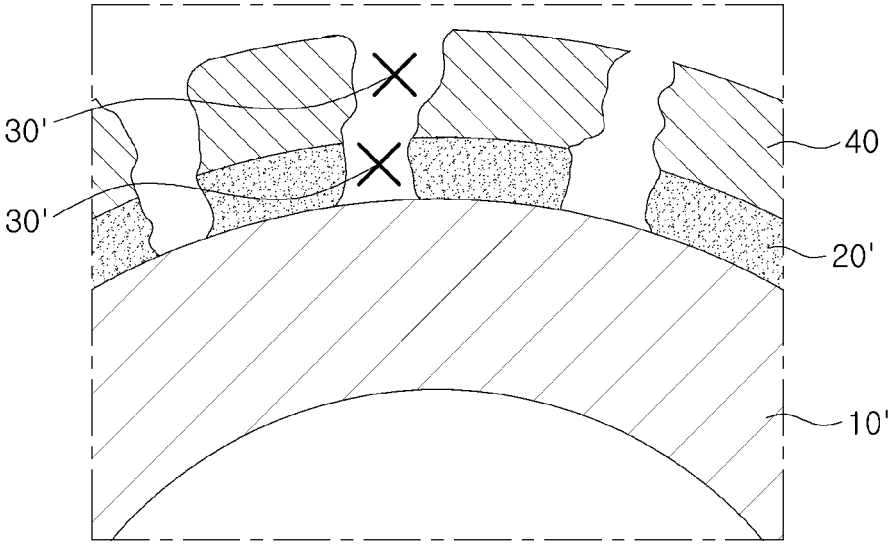

【Fig. 3】
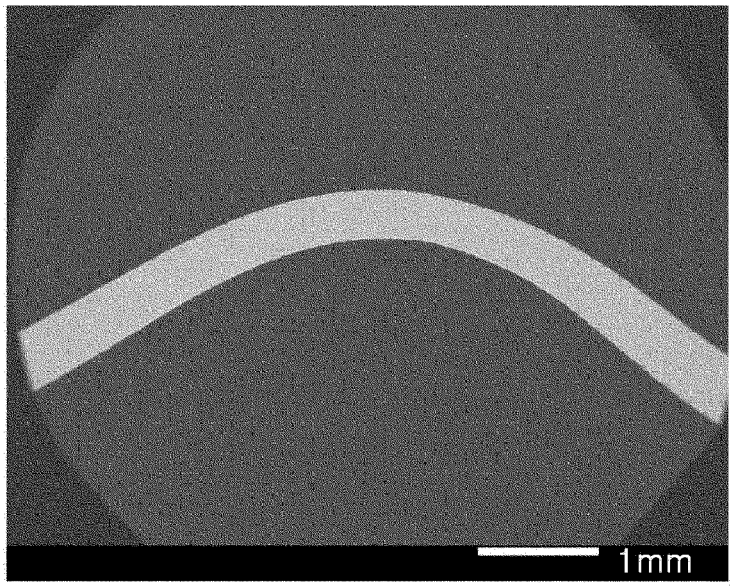
【Fig. 4】
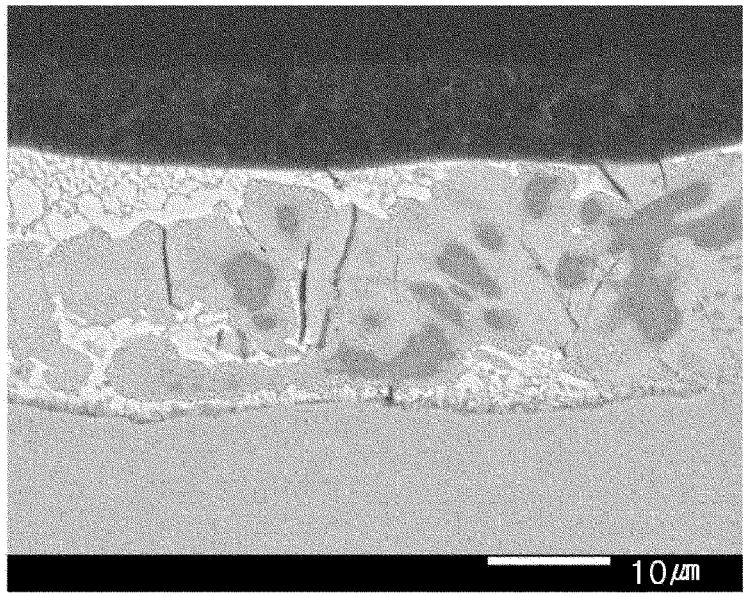

【Fig. 5】
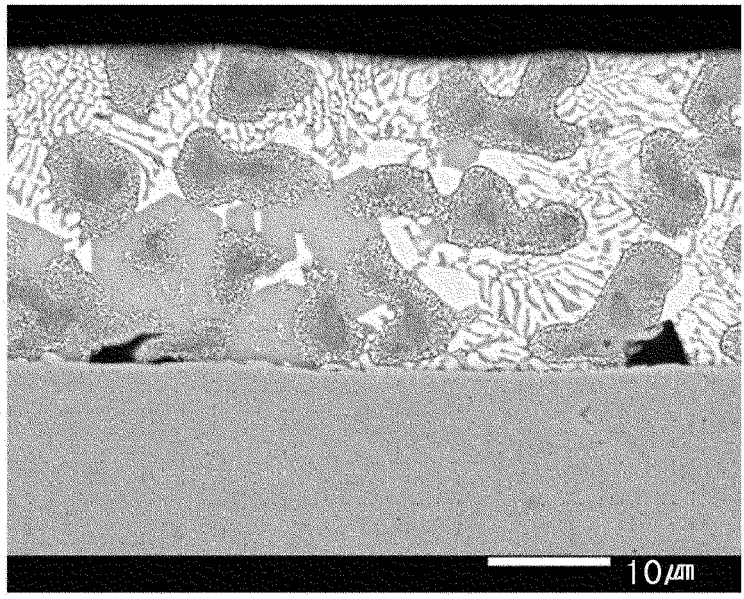

HOT-DIP Zn—Al—Mg-BASED ALLOY-PLATED STEEL MATERIAL HAVING EXCELLENT CORROSION RESISTANCE OF PROCESSED PORTION, AND METHOD FOR MANUFACTURING SAME

CROSS-REFERENCE OF RELATED APPLICATIONS

This application is the U.S. National Phase under 35 U.S.C. § 371 of International Patent Application No. PCT/KR2020/017416, filed on Dec. 2, 2020, which in turn claims the benefit of Korean Application No. 10-2019-0169494, filed on Dec. 18, 2019, the entire disclosures of which applications are incorporated by reference herein.

TECHNICAL FIELD

The present disclosure relates to a hot-dip Zn—Al—Mg-based alloy-plated steel material having excellent corrosion resistance in a processed portion, and a method for manufacturing the same.

BACKGROUND ART

A steel material treated with zinc plating protects the steel material from corrosion by a sacrificial anticorrosive action in which zinc having a higher oxidation potential is dissolved before a base steel and a corrosion inhibitory action in which corrosion of a densely formed zinc corrosion product is delayed. However, in consideration of worsening corrosive environment and resource and energy saving, a lot of effort has been made to improve corrosion resistance.

As an example, zinc-aluminum alloy plating in which 5 wt % or 55 wt % of aluminum is added to zinc has been studied. However, the zinc-aluminum alloy plating has excellent corrosion resistance, but has a disadvantage in terms of long-term durability because aluminum is more easily dissolved than zinc in alkaline conditions. In addition to the plating described above, various types of alloy plating have been researched.

Recently, as a result of these efforts, it has been possible to significantly improve corrosion resistance by adding Mg to a plating bath. Patent Document 1 relates to a steel material for a concrete structure that includes a Zn—Mg—Al alloy-plated layer containing 0.05 to 10.0% of Mg, 0.1 to 10.0% of Al, and a balance of Zn and inevitable impurities. Large cracks are generated in a processed portion due to formation of a coarse plating texture, such that it is difficult to efficiently suppress corrosion of iron.

Patent Document 2 relates to a color steel sheet having a structure in which cracks in a coating film are absorbed by applying a polymer polyester-based paint to one surface of a base steel sheet such as a hot-dip zinc-plated steel sheet, an electro-zinc-plated steel sheet, or an aluminum steel sheet. When sizes of cracks generated in a plated layer of the base steel sheet due to processing are larger than a certain size, the coating film may not absorb the cracks, and the base steel sheet is exposed, such that it is difficult to effectively protect the coated steel sheet from corrosion.

Patent Document 3 relates to a zinc-aluminum-based alloy-plated steel sheet in which a Mg2Si alloy phase and an oxide coating film are formed by controlling an intermetallic compound with a Cr component in a plated layer and securing corrosion resistance after processing by peeling of the plated layer and a reduction in generation of cracks in the plating film through formation of an AlCr2 phase. It is difficult to control components in a plating bath due to addition of Cr and Si components, and dross that is difficult to regenerate is generated, such that production management and production costs are increased.

Related Art Documents (Patent Document 1) Japanese Patent Laid-Open Publication No. 1999-158656

(Patent Document 2) Korean Patent Laid-Open Publication No. 2002-0004231

(Patent Document 3) Korean Patent Laid-Open Publication No. 2014-0018098

DISCLOSURE

Technical Problem

An aspect of the present disclosure is to provide a hot-dip Zn—Al—Mg-based alloy-plated steel material having excellent corrosion resistance in a processed portion, and a method for manufacturing the same.

Technical Solution

According to an exemplary embodiment in the present disclosure, a hot-dip Zn—Al—Mg-based alloy-plated steel material having excellent corrosion resistance in a processed portion includes: abase steel; and a hot-dip alloy-plated layer formed on the base steel, wherein the hot-dip alloy-plated layer contains, by wt %, more than 8% to 25% of Al, more than 4% to 12% of Mg, and a balance of Zn and inevitable impurities, a fraction of a MgZn2 phase in the hot-dip alloy-plated layer is 10 to 45 area %, cracks are formed inside the MgZn2 phase, and the number of cracks present per 100 μm in a direction perpendicular to a thickness direction of a steel sheet in a field of view in which the cracks are observed based on a cross section in the thickness direction of the steel sheet is 3 to 80.

According to another exemplary embodiment in the present disclosure, a method for manufacturing a hot-dip Zn—Al—Mg-based alloy-plated steel material having excellent corrosion resistance in a processed portion includes: preparing a base steel; hot-dip plating the base steel by passing the base steel through a plating bath containing, by wt %, more than 8% to 25% of Al, more than 4% to 12% of Mg, and a balance of Zn and inevitable impurities; and gas wiping and cooling the hot-dip plated base steel to form a hot-dip alloy-plated layer on the base steel, wherein the cooling includes: a first stage of applying gas having a dew point temperature of −5 to 50° C.; a second stage of performing cooling so that a difference in temperature between a steel material and a water-cooling bath is 10 to 300° C.; and a third stage of applying skin pass milling and tension leveling.

Advantageous Effects

As set forth above, according to an aspect of the present disclosure, a hot-dip Zn—Al—Mg-based alloy-plated steel material having excellent corrosion resistance in a processed portion may be provided, such that a lifespan of a structure in a corrosive environment is extended.

DESCRIPTION OF DRAWINGS

FIG. 1 is a schematic view illustrating a state of a processed portion after processing a hot-dip Zn—Al—Mg-based alloy-plated steel material according to an exemplary embodiment in the present disclosure.

FIG. 2 is a schematic view illustrating a state of a processed portion after processing a hot-dip Zn—Al—Mg-based alloy-plated steel material according to the related art.

FIG. 3 is a photograph obtained by observing a cross section of a steel material subjected to bending of Inventive Example 17 with an electron microscope.

FIG. 4 is a photograph obtained by observing the cross section of the steel material subjected to bending of Inventive Example 17 with an electron microscope.

FIG. 5 is a photograph obtained by observing a cross section of a steel material subjected to bending of Comparative Example 1 with an electron microscope.

BEST MODE FOR INVENTION

Hereinafter, a hot-dip Zn—Al—Mg-based alloy-plated steel material having excellent corrosion resistance in a processed portion according to an exemplary embodiment in the present disclosure will be described.

The hot-dip alloy-plated steel material of the present disclosure includes: a base steel; and a hot-dip alloy-plated layer formed on the base steel.

In the present disclosure, the type of the base steel is not particularly limited, and for example, a steel sheet such as a hot-rolled steel sheet, a hot-rolled pickled steel sheet, or a cold-rolled steel sheet, a wire rod, a steel wire, or the like may be used. In addition, the base steel of the present disclosure may have all types of alloy compositions classified as steel materials in the art.

It is preferable that the hot-dip alloy-plated layer contains, by wt %, more than 8% to 25% of Al, more than 4% to 12% of Mg, and a balance of Zn and inevitable impurities. Al stabilizes Mg during production of molten metal, and also serves as a corrosion barrier for suppressing initial corrosion in a corrosive environment. When a content of Al is 8% or less, Mg cannot be stabilized during production of molten metal, such that Mg oxides are generated on a surface of the molten metal. When the content of Al exceeds 25%, the temperature of the plating bath is increased, such that severe corrosion occurs in various types of equipment installed in the plating bath. Therefore, the content of Al is preferably more than 8% to 25%. A lower limit of the content of Al is more preferably 10%. An upper limit of the content of Al is more preferably 20%. Mg serves to forma texture exhibiting corrosion resistance. When a content of Mg is 4% or less, corrosion resistance is not sufficiently exhibited, and when the content of Mg exceeds 12%, the temperature of the plating bath is increased, and Mg oxides are formed, which causes various problems such as deterioration of the material and an increase in cost. Therefore, the content of Mg is preferably more than 4% to 12%. A lower limit of the content of Mg is more preferably 5%. An upper limit of the content of Mg is more preferably 10%.

The hot-dip alloy-plated layer may further contain one or more selected from the group consisting of Be, Ca, Ce, Li, Sc, Sr, V, and Y in a total amount of 0.0005 to 0.009% in order to stabilize Mg. When the content of the additional alloying elements is less than 0.0005%, the effect of stabilizing Mg is not substantially exhibited, and when the content of the additional alloying elements exceeds 0.009%, the hot-dip plated layer is solidified late, and thus, preferential corrosion occurs, such that corrosion resistance is deteriorated, and the cost is also increased. Therefore, the total amount of the one or more selected from the group consisting of Be, Ca, Ce, Li, Sc, Sr, V, and Y is preferably 0.0005 to 0.009%. A lower limit of the total amount of the additional alloying elements is more preferably 0.003%. An upper limit of the total amount of the alloying elements is more preferably 0.008%.

The hot-dip Zn—Al—Mg-based alloy-plated steel material according to an exemplary embodiment in the present disclosure contains various solidified phases in the hot-dip alloy-plated layer. The solidified phases may include various phases such as a solid-solution phase, a eutectic phase, and an intermetallic compound. The single phase may be a solid-solution Al phase, a solid-solution Mg phase, or a solid-solution Zn phase, the eutectic phase may be a binary or ternary eutectic phase containing the Al, Mg, and Zn, and the intermetallic compound may contain MgZn2, Mg2Zn11, Mg32(Al,Zn)49, and the like. In addition, in a case where the one or more selected from the group consisting of Be, Ca, Ce, Li, Sc, Sr, V, and Y that may be additionally added to stabilize Mg are contained in the hot-dip alloy-plated layer, the one or more elements of Be, Ca, Ce, Li, Sc, Sr, V, and Y may be contained in the solid-solution phase, the eutectic phase, or the intermetallic compound.

A fraction of the MgZn2 phase in the hot-dip alloy-plated layer is preferably 10 to 45 area %. The MgZn2 phase is a phase exhibiting corrosion resistance and having high hardness. When the fraction thereof is less than 10%, corrosion resistance is not sufficient in a water environment and a salt water environment, and cracks are not generated due to stress distribution. The corrosion resistance is increased up to 45% of the fraction of the MgZn2 phase, and when the fraction of the MgZn2 phase exceeds 45%, excessive cracks are generated, which adversely affects the corrosion resistance of the processed portion. Therefore, the fraction of the MgZn2 phase in the hot-dip alloy-plated layer is preferably 10 to 45 area %. A lower limit of the fraction of the MgZn2 phase is more preferably 20%. An upper limit of the fraction of the MgZn2 phase is more preferably 35%.

Meanwhile, the hot-dip Zn—Al—Mg-based alloy-plated steel material according to an exemplary embodiment in the present disclosure may be used by various types of processing. For example, the hot-dip Zn—Al—Mg-based alloy-plated steel material may be applied as indoor and outdoor building materials, materials for home appliances and automobiles, and the like, through pipe forming, bending, press processing, and the like. However, in a case where an elongation limit of the hot-dip alloy-plated layer is exceeded at a processed portion formed at the time of such processing, cracks are generated. In this case, the generated cracks cause deterioration of the corrosion resistance of the processed portion, and when intervals between the cracks are large, the base material may not be protected anymore, such that the base material is corroded.

Therefore, as a result of conducting studies to improve corrosion resistance of the processed portion formed at the time of processing the hot-dip Zn—Al—Mg-based alloy-plated steel material, the inventors of the present disclosure have found that the corrosion resistance may be improved by controlling the cracks in the zinc alloy-plated layer at minute intervals. More specifically, it is a method to retain microcracks in advance in the MgZn2 phase, which is a texture having high hardness, among various phases present in the hot-dip alloy-plated layer. To this end, the cracks are formed inside the MgZn2 phase, and the number of cracks present per 100 μm in a direction perpendicular to a thickness direction of a steel sheet in a field of view in which the cracks are observed based on a cross section in the thickness direction of the steel sheet is set to 3 to 80. Here, "the field of view in which the cracks are observed" mentioned above refers to a photograph obtained by observing the cross section of the steel sheet with a microscope. When the number of cracks per 100 μm is less than 3, coarse cracks are generated in the hot-dip alloy-plated layer during processing, such that it is difficult to effectively improve the corrosion resistance of the processed portion. When the number of cracks per 100 μm exceeds 80, the plated layer is separated due to the cracks, and as a result, the plated layer is detached from the base steel sheet, which adversely affects the corrosion resistance. In addition, the total length of the cracks present inside the MgZn2 phase may be 3 to 300 μm. When the total length of the cracks is less than 3 μm, intervals between the cracks in the processed portion are increased, and thus, the corrosion resistance may be deteriorated. When the total length of the cracks exceeds 300 μm, as cracks in a transverse direction are increased, the plated layer is substantially changed to powder, and thus, the steel material is difficult to use commercially.

FIG. 1 is a schematic view illustrating a state of a processed portion after processing a hot-dip Zn—Al—Mg-based alloy-plated steel material according to an exemplary embodiment in the present disclosure. FIG. 2 is a schematic view illustrating a state of a processed portion after processing a hot-dip Zn—Al—Mg-based alloy-plated steel material according to the related art. A hot-dip Zn—Al—Mg-based alloy-plated steel material 100 of the present disclosure provided as described above may improve corrosion resistance by preventing a base steel 10 from being exposed to the external environment due to microcracks 30 present in a hot-dip alloy-plated layer 20 formed on the base steel 10 during processing. On the other hand, in a hot-dip Zn—Al—Mg-based alloy-plated steel material 100' according to the related art, coarse cracks 30' are generated in a hot-dip alloy-plated layer 20' formed on a base steel 10' during processing, such that coarse cracks are also generated in a coating layer 40 formed on the hot-dip alloy-plated layer. As a result, the base steel is exposed to the external environment and corrosion of the base steel occurs.

Hereinafter, a method for manufacturing a hot-dip Zn—Al—Mg-based alloy-plated steel material having excellent corrosion resistance in a processed portion according to an exemplary embodiment in the present disclosure will be described.

First, a base steel sheet is prepared. When the base steel sheet is prepared, a degreasing, cleaning, or picking process may be performed to clean a surface of the base steel sheet by removing impurities on the surface of the steel sheet, such as oil.

Thereafter, before hot-dip plating, the base steel sheet may be subjected to heat treatment commonly performed in the art. Therefore, in the present disclosure, the heat treatment conditions are not particularly limited. However, for example, a heat treatment temperature may be 400 to 900° C. In addition, for example, as an atmospheric gas, hydrogen, nitrogen, oxygen, argon, carbon monoxide, carbon dioxide, moisture, and the like may be used, and 5 to 20 vol % of hydrogen, 80 to 95 vol % of nitrogen, and the like may be used.

Thereafter, the base steel sheet is hot-dip plated by passing the base steel sheet through a plating bath containing, by wt %, more than 8% to 25% of Al, more than 4% to 12% of Mg, and a balance of Zn and inevitable impurities. The plating bath may further contain one or more selected from the group consisting of Be, Ca, Ce, Li, Sc, Sr, V, and Y in a total amount of 0.0005 to 0.009%. Meanwhile, in the present disclosure, a plating bath temperature is not particularly limited. A plating bath temperature commonly used in the art may be used, and for example, a common plating bath temperature may be 400 to 550° C.

Thereafter, the hot-dip plated base steel sheet is gas-wiped and cooled to form a hot-dip alloy-plated layer on the base steel sheet. A coating weight is controlled through the gas wiping, such that a hot-dip alloy-plated layer having a desired thickness may be formed. Meanwhile, in the present disclosure, a process performed through the following three stages to be described below is performed during the cooling, such that a hot-dip alloy-plated layer in which microcracks to be obtained in the present disclosure are formed is formed. When the process of the following three stages is not met, microcracks are not formed, and thus, corrosion resistance is not sufficiently secured, the working environment becomes worse, the manufacturing cost is increased, and occurrence of surface defects is increased.

First, a first stage of applying gas having a dew point temperature of −5 to 50° C. is performed. When the dew point temperature of the gas is lower than −5° C., insufficient cracks are generated in the MgZn2 phase, and when the dew point temperature of the gas exceeds 50° C., cracks generated in the MgZn2 phase are saturated, and the working environment becomes worse. A lower limit of the dew point temperature is more preferably 0° C. An upper limit of the dew point temperature is more preferably 30° C.

Thereafter, a second stage of performing cooling so that a difference in temperature between a steel material and a water-cooling bath is 10 to 300° C. is performed. When the hot-dip alloy-plated layer is solidified to some extent through the plating, the steel material in which the hot-dip alloy-plated layer is formed is immersed in a water-cooling bath, and at this time, it is preferable to set the difference in temperature between the steel material and the water-cooling bath to 10 to 300° C. When the difference in temperature is lower than 10° C., cracks generated in the MgZn2 phase are saturated, and when the difference in temperature exceeds 300° C., the surface quality is deteriorated. A lower limit of the difference in temperature is more preferably 30° C. An upper limit of the difference in temperature is more preferably 150° C.

Thereafter, a third stage of applying skin pass milling to the steel material in which the hot-dip alloy-plated layer is formed is performed. In general, it is known that the skin pass milling is performed at a level that has an effect on only the surface of the steel sheet without the purpose of adjusting the thickness of the steel sheet, and may obtain effects such as continuous deformation, formation of surface roughness, and shape correction of the steel sheet. The skin pass milling is performed by being included in a continuous hot-dip plating process for commercial production in order to obtain the above effects. In the present disclosure, sufficient effects to be obtained by the present disclosure may be obtained only by applying the skin pass milling, and specific conditions are not particularly limited as long as the effects such as continuous deformation, formation of surface roughness, and shape correction of the steel sheet may be obtained. In a case where the skin pass milling is not applied, a yield point elongation occurs, the surface roughness is not adjusted to a desired level, and shape defects such as camber and wave may occur, such that suitable quality for a commercial product is not obtained. Meanwhile, as described above, in the present disclosure, the skin pass milling conditions are not particularly limited, and for example, a reduction ratio of 2% or less (excluding 0%) may be applied. When the reduction ratio exceeds 2%, the plated layer is attached to a roll, which may cause surface defects. A lower limit of the reduction ratio in the skin pass milling is more preferably 0.5%, and an upper limit of the elongation in the skin pass milling is more preferably 1.5%. In addition, although a relationship between the skin pass milling and the present disclosure has not yet been revealed, it is presumed as follows. When the zinc alloy-plated layer is subjected to skin pass milling, cracks are intensively formed inside the MgZn2 phase in the plated layer. This is presumed because the MgZn2 phase has a high hardness value and a hexagonal crystal structure. In addition, it is presumed that formation of an advantageous hot-dip alloy-plated texture that may easily receive the action of the skin pass milling is induced by the first stage and second stage treatment, such that the effect of the skin pass milling is increased.

MODE FOR INVENTION

Hereinafter, the present disclosure will be described in more detail with reference to Examples. However, the following Examples are provided to illustrate and describe the present disclosure in detail, but are not intended to limit the scope of the present disclosure. This is because the scope of the present disclosure is determined by contents disclosed in the claims and contents reasonably inferred therefrom.

EXAMPLES

After a low-carbon steel cold-rolled steel sheet having a thickness of 0.8 mm was prepared, the cold-rolled steel sheet was degreased, and then, the degreased cold-rolled steel sheet was subjected to annealing heat treatment at 800° C. in a reducing atmosphere composed of 10 vol % hydrogen-90 vol % nitrogen. Thereafter, the heat-treated base steel sheet was immersed in a plating bath at 450° C. as shown in Table 1 and then hot-dip plated, a coating weight was controlled through gas wiping so that a thickness of a hot-dip alloy-plated layer was about 10 μm, and gas-cooling, water-cooling, and skin pass milling (SPM) were performed, thereby manufacturing a hot-dip Zn—Al—Mg-based alloy-plated steel material. At this time, in the gas-cooling and the water-cooling, the conditions shown in Table 1 were used. The hot-dip Zn—Al—Mg-based alloy-plated steel material was subjected to epoxy-based coating at a thickness of 10 μm. The alloy composition of the hot-dip alloy-plated layer of the hot-dip Zn—Al—Mg-based alloy-plated steel material manufactured as described above was measured. The results are shown in Table 1. In addition, after the hot-dip Zn—Al—Mg-based alloy-plated steel material was subjected to bending at a radius of 5 R and 90°, the fraction of the MgZn2 phase and the number of cracks in the hot-dip alloy-plated layer, the presence or absence of generation of cracks in the coating layer, the corrosion resistance of the processed portion, and the like were evaluated. The results are shown in Table 2.

The fraction of the MgZn2 phase in the hot-dip alloy-plated layer was measured using X-ray diffraction (XRD).

A cross section of the hot-dip Zn—Al—Mg-based alloy-plated steel material was magnified 2,000 times using a scanning electron microscope (SEM), and the number of cracks in the MgZn2 phase in the hot-dip alloy-plated layer was observed. As for the number of cracks, the number of cracks present per 100 μm in a direction perpendicular to a thickness direction of a steel sheet in a field of view in which the cracks were observed based on the cross section in the thickness direction of the steel sheet was measured.

After the cross section of the hot-dip Zn—Al—Mg-based alloy-plated steel material was magnified 2,000 times using the SEM, the presence or absence of generation of cracks in the coating layer was evaluated based on the following criteria.

○: The base steel was exposed to the external environment due to cracks in the coating layer and cracks in the plated layer.

X: The base steel was not exposed to the external environment because no cracks were generated in the coating layer.

After a salt water spray test was performed, the corrosion resistance of the processed portion was evaluated based on the following criteria. At this time, the spraying was performed under salt water spray test conditions of a salinity of 5%, a temperature of 35° C., a pH of 6.8, and the spray amount of salt water of 2 ml/80 $cm^2$·1 Hr.

○: No corrosion products were generated when observed after 10 days.

X: Corrosion products were generated when observed after 10 days.

TABLE 1

| Classification | First stage Gas dew point temperature (° C.) | Second stage Difference in temperature between steel material and water-cooling bath (° C.) | Third stage Whether or not SPM was applied | Alloy composition (wt %) Al | Mg | Other components |
|---|---|---|---|---|---|---|
| Inventive Example 1 | 20 | 52 | Applied | 12 | 6 | — |
| Inventive Example 2 | 20 | 86 | Applied | 15 | 7 | — |
| Inventive Example 3 | 50 | 150 | Applied | 20 | 9 | — |
| Inventive Example 4 | −5 | 300 | Applied | 18 | 11 | — |
| Inventive Example 5 | −5 | 10 | Applied | 16 | 5 | — |
| Inventive Example 6 | 50 | 65 | Applied | 8 | 4 | — |
| Inventive Example 7 | 50 | 300 | Applied | 25 | 12 | — |
| Comparative Example 1 | 20 | 74 | Applied | 6 | 3 | — |
| Comparative Example 2 | 20 | 10 | Applied | 20 | 13 | — |
| Inventive Example 8 | 0 | 86 | Applied | 12 | 6 | Li: 0.0005 |
| Inventive Example 9 | 0 | 67 | Applied | 12 | 6 | Li: 0.0090 |
| Comparative Example 3 | 0 | 35 | Applied | 12 | 6 | Li: 0.0500 |
| Inventive Example 10 | 0 | 89 | Applied | 12 | 6 | Ca: 0.0090 |
| Inventive Example 11 | −5 | 121 | Applied | 12 | 6 | Ce: 0.0090 |
| Inventive Example 12 | 0 | 57 | Applied | 12 | 6 | Be: 0.0090 |
| Inventive Example 13 | 50 | 66 | Applied | 12 | 6 | Sc: 0.0090 |
| Inventive Example 14 | 0 | 95 | Applied | 12 | 6 | Sr: 0.0090 |
| Inventive Example 15 | 0 | 300 | Applied | 12 | 6 | V: 0.0090 |
| Inventive Example 16 | 0 | 55 | Applied | 12 | 6 | Y: 0.0090 |

TABLE 1-continued

| Classification | First stage Gas dew point temperature (° C.) | Second stage Difference in temperature between steel material and water-cooling bath (° C.) | Third stage Whether or not SPM was applied | Alloy composition (wt %) Al | Mg | Other components |
|---|---|---|---|---|---|---|
| Inventive Example 17 | 0 | 54 | Applied | 12 | 5 | — |
| Inventive Example 18 | −5 | 10 | Applied | 12 | 5 | — |
| Inventive Example 19 | 50 | 300 | Applied | 12 | 5 | — |
| Comparative Example 4 | −10 | 8 | Not applied | 12 | 5 | — |
| Comparative Example 5 | 55 | 320 | Applied | 12 | 5 | — |
| Comparative Example 6 | 0 | 84 | Not applied | 12 | 5 | — |

TABLE 2

| Classification | MgZn2 phase fraction (area %) | Number of cracks in MgZn2 phase (number/100 μm) | Presence or absence of generation of cracks in coating layer | Corrosion resistance of processed portion |
|---|---|---|---|---|
| Inventive Example 1 | 30 | 35 | x | ○ |
| Inventive Example 2 | 33 | 30 | x | ○ |
| Inventive Example 3 | 38 | 58 | x | ○ |
| Inventive Example 4 | 42 | 68 | x | ○ |
| Inventive Example 5 | 22 | 3 | x | ○ |
| Inventive Example 6 | 10 | 20 | x | ○ |
| Inventive Example 7 | 45 | 80 | x | ○ |
| Comparative Example 1 | 8 | 0 | ○ | x |
| Comparative Example 2 | 52 | 92 | ○ | x |
| Inventive Example 8 | 28 | 43 | x | ○ |
| Inventive Example 9 | 31 | 58 | x | ○ |
| Comparative Example 3 | 25 | 47 | ○ | x |
| Inventive Example 10 | 27 | 35 | x | ○ |
| Inventive Example 11 | 22 | 20 | x | ○ |
| Inventive Example 12 | 28 | 33 | x | ○ |
| Inventive Example 13 | 36 | 73 | x | ○ |
| Inventive Example 14 | 33 | 58 | x | ○ |
| Inventive Example 15 | 34 | 47 | x | ○ |
| Inventive Example 16 | 31 | 37 | x | ○ |
| Inventive Example 17 | 29 | 38 | x | ○ |
| Inventive Example 18 | 12 | 20 | x | ○ |
| Inventive Example 19 | 36 | 55 | x | ○ |
| Comparative Example 4 | 5 | 2 | ○ | x |
| Comparative Example 5 | 50 | 103 | ○ | x |
| Comparative Example 6 | 26 | 0 | ○ | x |

As can be seen from Tables 1 and 2, in the cases of Inventive Examples 1 to 19 in which the alloy composition of the hot-dip alloy-plated layer, the MgZn2 phase fraction in the hot-dip alloy-plated layer, the number of cracks in the MgZn2 phase, and the manufacturing conditions suggested by the present disclosure were satisfied, it could be appreciated that the corrosion resistance of the processed portion was excellent.

In Comparative Example 1, the contents of Al and Mg in the hot-dip alloy-plated layer of the present disclosure were not satisfied, and it could be appreciated that the corrosion resistance of the processed portion was not excellent because the MgZn2 phase fraction in the hot-dip alloy-plated layer and the number of cracks in the MgZn2 phase suggested by the present disclosure were not satisfied.

In Comparative Example 2, the content of Mg in the hot-dip alloy-plated layer of the present disclosure was not satisfied, and it could be appreciated that the corrosion resistance of the processed portion was not excellent because the MgZn2 phase fraction in the hot-dip alloy-plated layer and the number of cracks in the MgZn2 phase suggested by the present disclosure were not satisfied.

In Comparative Example 3, the content of Li in the hot-dip alloy-plated layer of the present disclosure was not satisfied, and it could be appreciated that the corrosion resistance of the processed portion was not excellent.

In Comparative Example 4, the first stage to third stage treatment processes among the manufacturing conditions of the present disclosure were not satisfied, and it could be appreciated that the corrosion resistance of the processed portion was not excellent because the MgZn2 phase fraction in the hot-dip alloy-plated layer and the number of cracks in the MgZn2 phase suggested by the present disclosure were not satisfied.

In Comparative Example 5, the first stage and second stage treatment processes among the manufacturing conditions of the present disclosure were not satisfied, and it could be appreciated that the corrosion resistance of the processed portion was not excellent because the MgZn2 phase fraction in the hot-dip alloy-plated layer and the number of cracks in the MgZn2 phase suggested by the present disclosure were not satisfied.

In Comparative Example 6, the third stage treatment process among the manufacturing conditions of the present disclosure were not satisfied, and it could be appreciated that the corrosion resistance of the processed portion was not excellent because the MgZn2 phase fraction in the hot-dip alloy-plated layer and the number of cracks in the MgZn2 phase suggested by the present disclosure were not satisfied.

FIGS. 3 and 4 are photographs obtained by observing the cross section of the steel material subjected to bending of Inventive Example 17 with an electron microscope. FIG. 5 is a photograph obtained by observing the cross section of the steel material subjected to bending of Comparative Example 17 with an electron microscope. As can be seen from FIGS. 3 through 5, in the case of Inventive Example 1, it could be confirmed that the microcracks were generated in the hot-dip alloy-plated layer, and on the other hand, in the case of Comparative Example 1, it could be confirmed that the cracks were not formed in the hot-dip alloy-plated layer.

DETAILED DESCRIPTION OF MAIN ELEMENTS

10, 10': BASE STEEL
20, 20': HOT-DIP ALLOY-PLATED LAYER
30, 30': COARSE CRACKS
40: COATING LAYER
100, 100': HOT-DIP ZN-AL-MG-BASED ALLOY-PLATED STEEL MATERIAL

The invention claimed is:

1. A hot-dip Zn—Al—Mg-based alloy-plated steel material, comprising:

a base steel; and a hot-dip alloy-plated layer formed on the base steel, wherein the hot-dip alloy-plated layer contains, by wt %, more than 8% to 25% of Al, more than 5% to 12% of Mg, and a balance of Zn and inevitable impurities, a fraction of a MgZn2 phase in the hot-dip alloy-plated layer is 10 to 45 area %, cracks are formed inside the MgZn2 phase, the number of cracks present per 100 μm in a direction perpendicular to a thickness direction of a steel sheet in a field of view in which the cracks are observed based on a cross section in the thickness direction of the steel sheet is 3 to 80, and wherein a total length of the cracks is 3 to 300 μm.

2. The hot-dip Zn—Al—Mg-based alloy-plated steel material of claim 1, wherein the hot-dip alloy-plated layer further contains one or more selected from the group consisting of Be, Ca, Ce, Li, Sc, Sr, V and Y in a total amount of 0.0005 to 0.009 wt %.

* * * * *